US007140364B1

(12) United States Patent
Buffington

(10) Patent No.: US 7,140,364 B1
(45) Date of Patent: Nov. 28, 2006

(54) PREFABRICATED MODULAR, LIGHTWEIGHT FIREPLACE

(76) Inventor: Stuart P. Buffington, 88 Matterhorn, Cedar Crest, NM (US) 87008

( * ) Notice: Subject to any disclaimer, the term of this patent is extended or adjusted under 35 U.S.C. 154(b) by 0 days.

(21) Appl. No.: 11/026,818

(22) Filed: Dec. 29, 2004

Related U.S. Application Data

(60) Provisional application No. 60/569,104, filed on May 7, 2004, provisional application No. 60/540,908, filed on Jan. 30, 2004.

(51) Int. Cl.
*F24C 15/08* (2006.01)

(52) U.S. Cl. ..... 126/500; 126/512

(58) Field of Classification Search ..... 126/8, 126/512, 200, 144, 145, 151, 544–551, 500, 126/144.1; 502/36.3
See application file for complete search history.

(56) References Cited

U.S. PATENT DOCUMENTS

| | | | | | |
|---|---|---|---|---|---|
| 926,910 | A | * | 7/1909 | Taylor | 126/500 |
| 1,069,944 | A | * | 8/1913 | Haggard | 126/500 |
| 1,342,329 | A | | 6/1920 | Freeman | |
| 1,867,110 | A | * | 7/1932 | Signore | 126/86 |
| 2,446,729 | A | * | 8/1948 | Van Alstyne | 454/44 |
| 2,737,944 | A | * | 3/1956 | Person | 126/500 |
| 2,752,691 | A | | 7/1956 | Bender | |
| 2,821,975 | A | * | 2/1958 | Thulman | 126/500 |
| 3,228,387 | A | * | 1/1966 | Milan | 126/500 |
| 3,289,666 | A | * | 12/1966 | Prather | 126/500 |
| 3,301,249 | A | * | 1/1967 | Hendricks | 126/554 |
| 3,339,540 | A | | 9/1967 | Kreider | |
| 3,413,967 | A | * | 12/1968 | Hoock | 431/288 |
| 3,460,525 | A | * | 8/1969 | Bryant | 126/536 |
| 3,721,225 | A | * | 3/1973 | Tidwell | 126/536 |

(Continued)

*Primary Examiner*—Carl D. Price
(74) *Attorney, Agent, or Firm*—Rod D. Baker

(57) ABSTRACT

A lightweight, prefabricated, modular masonry fireplace. The firebox is pre-cast in modular sections of lightweight vermiculate concrete. A kiva-style version of the fireplace features a modular firebox disposed within an outer facade made from a tubular steel frame, covered with metal-mesh stuccoed and plastered to present the aesthetic configuration of a sculpted adobe fireplace. An alternative, but equally desirable Rumford-style version of the fireplace does not require an outer facade, but also is assembled from lightweight modular sections.

The firebox of all embodiments is cast in modular sections. A central body section of the firebox is placed upon a base, and a smoke plenum section is placed upon the central body section. The central body section, and in some embodiments a portion of the smoke plenum section, define and mostly surround the combustion chamber. The central body section may be a single integral pre-cast component, possibly including an arcuate horizontal section, or may include a plurality of pre-cast planar sections interconnected to collectively constitute the central body portion. All modular components are fashioned from lightweight vermiculite concrete; the combustion chamber is lined with split refractory firebrick or suitable cast refractory alternative. The cast smoke chamber plenum section, which may be a single pre-cast component or a plurality of interconnected modular components, stacks upon the central body to provide a transition from the masonry firebox to a double-walled chimney system.

The fireplace can be placed in a room corner or in a chase on a flat wall. It can also be installed over wood floors, or on upper floors, in old or new construction.

17 Claims, 13 Drawing Sheets

U.S. PATENT DOCUMENTS 3,910,251 A 10/1975 Andrew
3,933,515 A * 1/1976 Yang ..... 106/700
4,016,859 A * 4/1977 Landowski ..... 126/518
4,041,671 A * 8/1977 Nicholson ..... 52/745.07
4,041,929 A 8/1977 Cooksey
4,151,827 A * 5/1979 Rae ..... 126/521
4,248,206 A * 2/1981 Orthey, Jr. ..... 126/518
4,252,105 A * 2/1981 Johnson ..... 126/502
4,305,374 A * 12/1981 Taylor ..... 126/500
4,422,438 A 12/1983 Scholz et al.
4,466,420 A * 8/1984 Ernisse et al. ..... 126/509
4,583,495 A 4/1986 Hill et al.
4,825,849 A 5/1989 Armour
5,052,311 A 10/1991 Kincaid
5,168,862 A 12/1992 McGee
5,186,161 A * 2/1993 Shumock ..... 126/500
5,915,374 A * 6/1999 Susany ..... 126/500
6,109,257 A 8/2000 Hodge et al.
6,892,505 B1 * 5/2005 Pingitore ..... 52/742.14

* cited by examiner

FIG. 11A
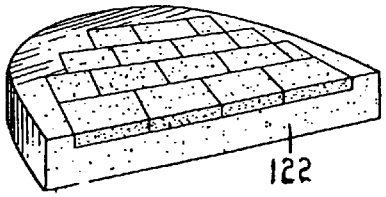
FIG. 11B
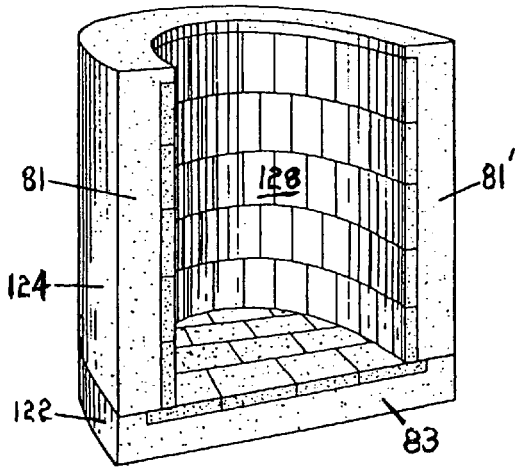
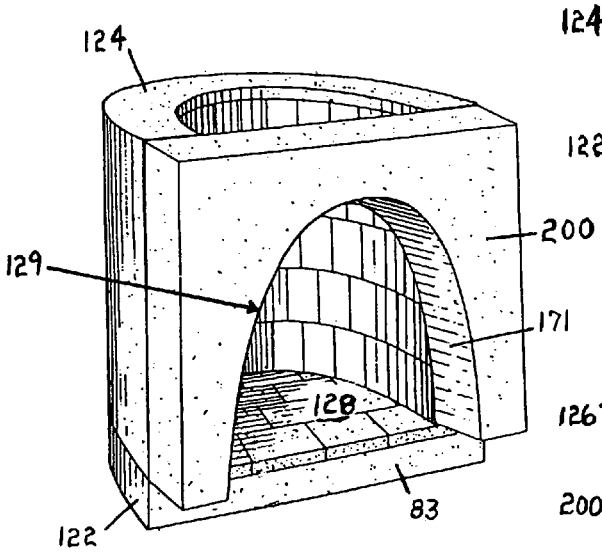
FIG. 11C
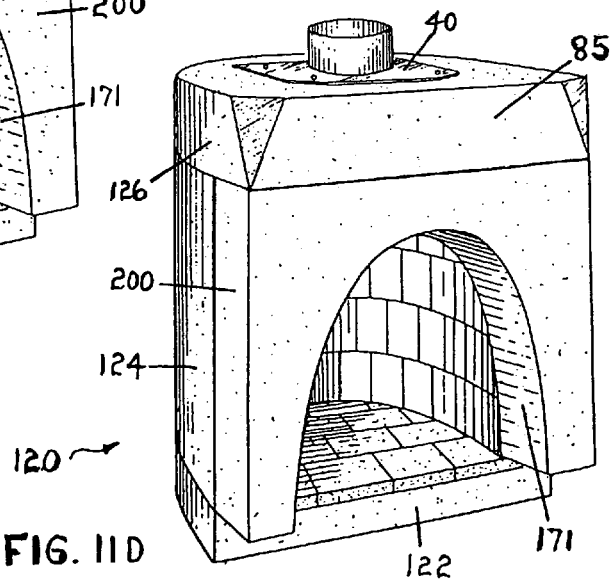
FIG. 11D

PREFABRICATED MODULAR, LIGHTWEIGHT FIREPLACE

CROSS-REFERENCE TO RELATED APPLICATIONS

This application claims the benefit of the filing of U.S. Provisional Patent Application Ser. No. 60/569,104, entitled "Prefabricated Modular, Lightweight, Fireplace," to Stuart P. Buffington, filed on May 7, 2004; and of U.S. Provisional Patent Application Ser. No. 60/540,908, entitled "Prefabricated Modular, Lightweight, Fireplace," to Stuart P. Buffington, filed on Jan. 30, 2004, and the specifications thereof are incorporated herein by reference.

This application is related to U.S. patent application Ser. No. 10/243,005, filed Sep. 13, 2002, entitled "Prefabricated Fireplace", to Stuart P. Buffington, which application is a continuation-in-part of U.S. patent application Ser. No. 09/627,183, entitled "Kiva Fireplace," to Stuart P. Buffington, filed Jul. 27, 2000, now abandoned. The specifications thereof are incorporated herein by reference.

BACKGROUND OF THE INVENTION

1. Field of the Invention (Technical Field)

The present invention relates to fireplaces, particularly to a lightweight prefabricated fireplace for residential or small business installation.

2. Background Art

Fireplaces are popular features for homes and small businesses. In some locations, a fireplace may serve as a significant or supplemental source of building heat in colder climates. A fireplace may also be a centerpiece of room decor, and when in use improve the ambiance and mood of the room. In the western United States, especially the southwestern United States, a particular style of fireplace sometimes called a "kiva" fireplace has become popular. Kiva-style fireplaces are patterned after the fireplaces used by ancient and modern Native Americans (particularly the Pueblo and Hopi peoples). A kiva fireplace features gentle, rounded exterior contours and a relatively small firebox with a rounded concave interior combustion chamber. A kiva-style fireplace typically has a generally cylindrical chimney of modest diameter that is visible within the interior of the room.

Currently, fireplaces, particularly kiva- and Rumford-style fireplaces, ordinarily are installed during the construction of the building. They usually are constructed from relatively heavyweight materials, e.g., adobe bricks, stones, masonry, mortar, and the like. While such "original installation" kiva fireplaces are durable and handsome, their character, particularly their weight, normally requires that the building be specially designed to accommodate them. A conventional kiva fireplace generally cannot be "retrofitted" into an existing structure, especially on an upper story or floor, at least not without extensive structure remodeling.

A variety of fireplace types are disclosed in the following patents, which offer background in the art: U.S. Pat. No. 6,109,257 to Hodge et al.; U.S. Pat. No. 4,422,438 to Scholtz et al., U.S. Pat. No. 5,168,862 to McGee; U.S. Pat. No. 5,052,3112 to Kincaid A need remains for a lightweight masonry prefabricated fireplace, especially a kiva—or a contemporary Rumford-style fireplace that can be easily installed into existing structures, such as the room of a residence.

BRIEF SUMMARY OF THE INVENTION

A lightweight prefabricated masonry/steel kiva-style or contemporary Rumford-style fireplace, and method of making same. The kiva-style version of the apparatus features a modular firebox disposed within an outer facade. The firebox of all versions and embodiments is cast in modular sections. A central body section of the firebox is placed upon a base, and a smoke plenum section is placed upon the central body section. The central body section, and in some embodiments a portion of the smoke plenum section, define and mostly surround the combustion chamber. The central body section may be a single integral pre-cast component, possibly including an arcuate horizontal section, or may include a plurality of pre-cast planar sections interconnected to collectively constitute the central body portion. All modular components are fashioned from lightweight vermiculite concrete; the combustion chamber is lined with split refractory firebrick or cast refractory. For the kiva embodiment, the firebox is surrounded by a facade made from a tubular steel frame, covered with metal-mesh stuccoed and plastered to present the aesthetic configuration of a sculpted adobe fireplace. The cast smoke chamber plenum section, which may be a single pre-cast component or a plurality of interconnected modular components, stacks upon the central body to provide a transition from the masonry firebox to a double-walled chimney system. The apparatus may be placed in a room corner or in a chase on a flat wall. It can also be installed over wood floors, in old or new construction.

A primary object of the present invention is to provide a complete fireplace that can be installed with the simplicity of a zero-clearance unit and yet having the appearance of a total custom-built kiva adobe fireplace or contemporary Rumford-style fireplace.

Another object of the present invention is to eliminate the undesirable cold convection that occurs with conventional masonry fireplaces.

A primary advantage of the present invention is that it provides a lightweight masonry firebox that can be placed in close proximity to walls containing combustible materials and can be installed over wooden floors.

Another advantage of the present invention is that it eliminates the need for special footings, such as those required to support the massive weight of typical all-masonry fireplaces.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIGS. 11A–11D are perspective views of the firebox of a kiva-style embodiment of the invention, shown in various stages of assembly;

FIG. 12B is a bottom view of the plenum component, while FIG. 12A is a sectional view taken along section line A—A on FIG. 12B and FIG. 12C is a sectional view taken along section line C—C on FIG. 12B;

DETAILED DESCRIPTION OF THE INVENTION

Figure 1:
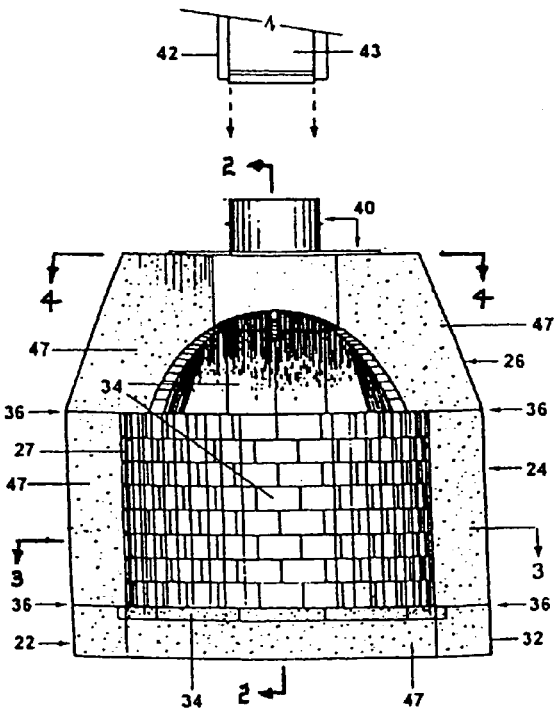
FIG. 1 is a front view of a firebox component of the fireplace apparatus useable in a kiva-style embodiment of the present invention.

Currently, fireplaces are generally of two types: all-masonry fireplaces and steel "zero-clearance" fireplaces. The present invention offers the homeowner or homebuilder a lightweight alternative fireplace that may be installed in a wide variety of locations, including the upper floors of existing buildings of two or more stories. While the invention has utility in new construction, it is contemplated that an advantage of the invention is its suitability for use in existing buildings. Thus, the inventive fireplace may be used in either original or "retrofit" installation.

The invention is a wood burning fireplace that can be converted, if desired, to gas burning (with ceramic logs), without requiring any basic design change. In its preferred embodiment, the inventive apparatus provides the user with an aesthetic southwestern style kiva fireplace, or a contemporary Rumford-style fireplace, both of which provide a supplementary heat source.

The fireplace according to the invention is advantageous over the known art in several respects. It is much lighter than the masonry fireplaces of conventional construction, and requires no special footings. It eliminates cold convection that occurs with solid masonry fireplaces. It can be installed over wood floors in new or existing homes. In contrast with known "zero-clearance" fireplaces, the present kiva-style invention features a semi-circular firebrick (or lightweight concrete) firebox interior with a lightweight stuccoed tubular steel and mesh frame. The frame of the inventive fireplace permits the unit to have the shape of a traditional kiva fireplace, including an arched firebox opening. In sum, the user can appreciate the aesthetics of a real southwestern kiva fireplace without the disadvantages of an all masonry fireplace or steel zero-clearance fireplace. The Rumford-style version of the invention offers the same advantages, but ordinarily features a rectilinear firebox having flat refractory panels, and does not require the tubular-framed outer facade.

The invention is a lightweight masonry fireplace that may burn either solid fuel, particularly wood, or fluid fuel, such as natural gas or propane. The firebox of the invention may be placed in direct contact or close proximity to combustible building materials, and accordingly may be placed against or close to building walls. The firebox disclosed herein can be used in either new construction or remodeling and in close proximity to the structure's walls. The firebox is zero-clearance in basic type, while the fireplace unit features a double-walled, air-cooled metal chimney system. As mentioned, no special footings are required, so the invention may be installed over wood floors.

The firebox of the kiva-style embodiment of the present invention is fashioned from refractory firebrick inside the combustion chamber, which in turn is partially surrounded by an outer shell of lightweight concrete. The invention's lightweight facade, which houses the firebox, achieves the appearance of a custom adobe fireplace.

Figure 5:
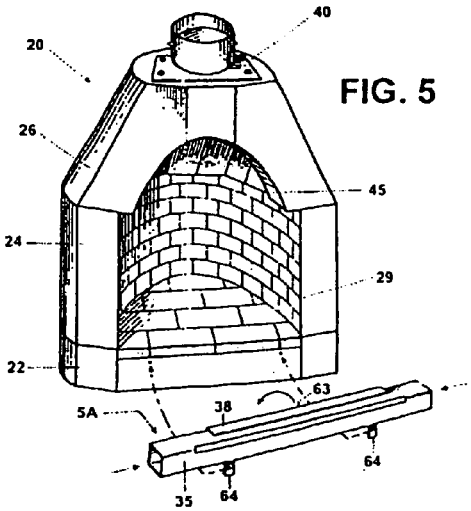
FIG. 5 is a front, perspective, partially exploded view of the firebox component of the fireplace apparatus of the present invention, showing how a combustion air flume may be attached to the front of the assembled apparatus.
Figure 6:
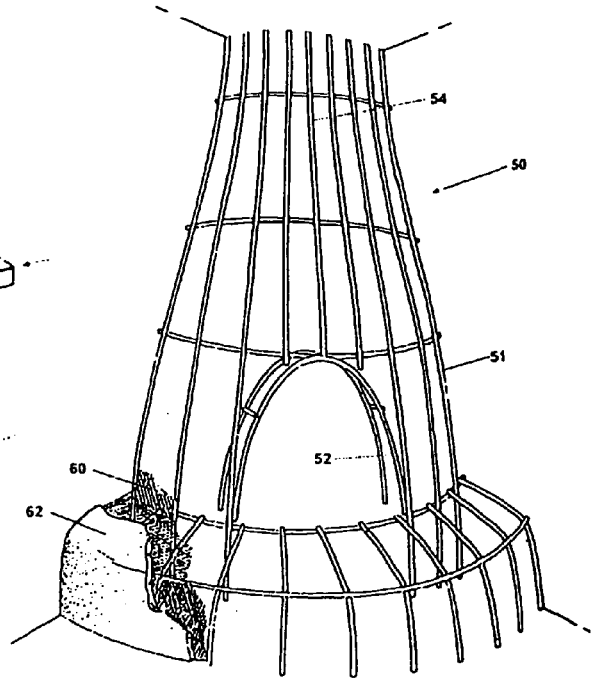
FIG. 6 is a front perspective view of the facade frame according to the present invention, to approximately the same scale as FIG. 5, the facade frame allowing a facade to surround and enclose the firebox component seen in FIG. 5.
Figure 7:
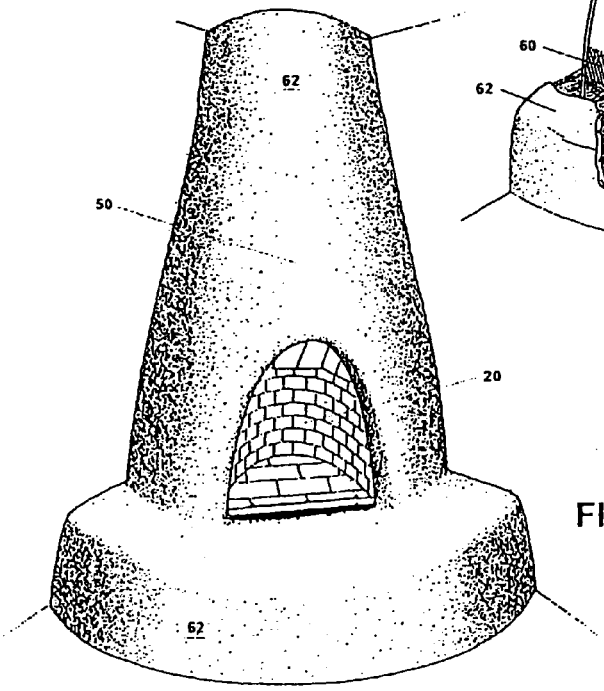
FIG. 7 is a front view of a completed facade component of the invention, disposed around the firebox component, to provide a completed kiva fireplace generally according to the present invention.

Attention is invited to the drawing figures, especially FIGS. 1–6, which illustrate and disclose aspects of the invention. In the kiva-style embodiment of these figures, apparatus of the invention includes two major components, the firebox 20 (FIGS. 1–5) and the facade 50 (FIGS. 6 and 7). These elements are manufactured mostly off-site, and largely by pre-casting in vermiculite concrete, and as modular components are transported from the manufacturing facility to the residential or small business job site for installation. The firebox 20 is assembled and secured in place within the structure (e.g. preferably in the corner of a room), and then is covered and surrounded by the facade 50. When the inventive fireplace is completely and properly assembled, the facade 50 substantially surrounds and covers the firebox 20, there being however a volume of air space between the facade and the exterior of the firebox.

Figure 2:
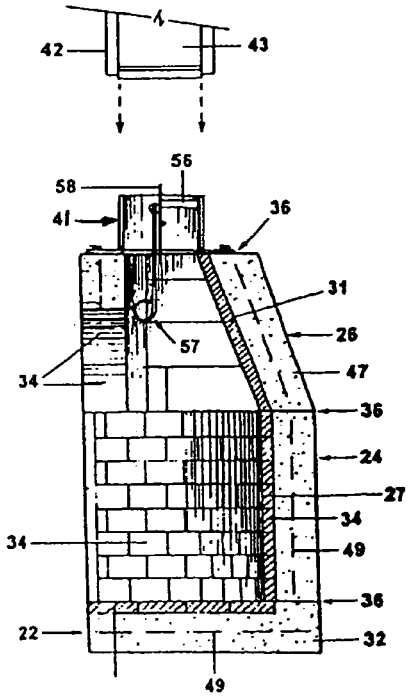
FIG. 2 is a side sectional view of the firebox component seen in FIG. 1, taken along section line 2—2 in FIG. 1.
Figure 3:
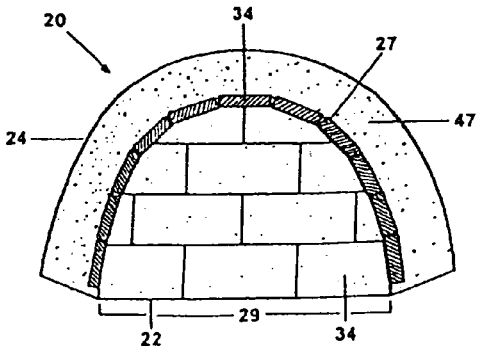
FIG. 3 is a plan sectional view, from above, of the firebox component seen in FIG. 1, taken along section line 3—3 in FIG. 1.
Figure 4:
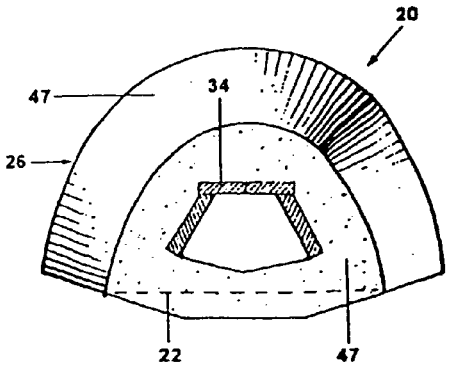
FIG. 4 is another plan sectional view, from above, of the firebox component seen in FIG. 1, taken along section line 4—4 in FIG. 1.

FIGS. 1–4 illustrate one embodiment of a firebox 20 according to the invention. The embodiment of FIGS. 1–4 is suitable for many applications, but more preferable embodiments thereof will be disclosed hereinafter. FIGS. 1–4, however, serve to illustrate generally the configuration of fireboxes according to the kiva-style embodiment invention. It is seen that the firebox 20 features three main subcomponents: a base 22, a pre-cast vermiculite concrete central body 24, and a smoke plenum section 26. The base 22, which has a generally semicircular convex exterior back, is placed upon the floor, or upon concrete or "cinder" blocks over a wood floor, of the room in which the invention is to be installed. The central body 24 has a concave interior chamber therein and a convex back, as suggested in FIG. 4, and is disposable upon the base 22 before the firebox 20 is useable. The central body 24 has an inner body wall 27 defining and partially surrounding a combustion chamber 28; the combustion chamber is the location of the fire when the completed apparatus is in use. The inner body wall 27 also at least partially defines a firebox aperture 29 opening into the combustion chamber 28. The combustion chamber is lined with split refractory fire brick or a One-inch thick cast refractory lining. As best seen in FIGS. 1, 3, and 5, the inner body wall 27 preferably has a substantially arcuate plan profile. A plurality of lightweight split refractory bricks 34 are cast into the inner body wall 27. As indicated by FIGS. 1–3, the central body 24 and the smoke plenum section 26 have a thick (e.g. 4 inches) outer shell 47 of lightweight vermiculate concrete, preferably reinforced with No. 16 gage 2-inch by 2-inch square grid welded wire screen 49.

The smoke plenum section 26 is disposable upon the central body 24 when the firebox is in use to contain a flame in the combustion chamber 28. The upper plenum section 26 also has an inner plenum wall 31 confronting and defining the upper bounds of the combustion chamber 28. As seen in FIGS. 1 and 2, the inner plenum wall 31 at least partially defines an upper portion 45 of the box aperture 29. This upper portion 45 in a kiva style fireplace may be a metal arch, for example, to define the arched firebox opening characteristic of kiva fireplaces (FIG. 7).

The facade 50 of the kiva-style embodiment is locatable around the firebox 20 to at least partially surround and enclose the firebox. The facade 50 preferably has a frame 51 crafted from lightweight steel tubes that have been bent and joined to outline the exterior contours of a typical kiva style fireplace, as best seen in FIG. 6. The frame 51 defines a facade aperture 52 as well as the chimney enclosure 54. An advantage of the kiva version of the apparatus is the use of bendable tubing to craft the frame 51, thereby permitting a fireplace facade exhibiting the smooth, graceful curves and rounded contours customarily associated with kiva style fireplaces.

Because the base 22, central body 24, and plenum section 26 are modular, they can be separately manufactured and transported to the job site, and there stacked one upon the other to assemble the firebox 20 as illustrated in FIGS. 1, 2, and 5. The central body 24 is connectable to the base 22, and the smoke plenum section 26 is connectable to the central body 24, using refractory mortar 36, so that the three main subcomponents of the firebox 20 are securely mortared together in the completed apparatus for use. The assembled firebox 20 is situated so that the central body 24 and plenum section 26 are at least about three inches from the nearest adjacent combustible building materials (e.g. walls). The facade frame 51 may then be placed over the installed firebox 20. The facade aperture 52 has a size and shape generally corresponding to the box aperture 29; these two apertures are alignable to permit access through the facade 50 into the combustion chamber 28 in the completed fireplace assembly, as seen in FIG. 7. With the facade aperture 51 and the box aperture 29 in registration, the edges of the apertures are in close adjacency, and can be sealed with mortar, to provide an integral aperture and to prevent smoke and debris from entering between the firebox and facade. The juncture of the front of the firebox 20 with the front of the facade 50, where the edges of their respective apertures come together, is the only area of substantial contact between the firebox and the facade. The firebox is within, but spaced-apart from, the facade 50.

To provide a fire-resistant and yet lightweight fireplace, the base 22 preferably is pre-cast of vermiculite concrete. As seen in FIGS. 1 and 3, for example, the base 22 preferably is generally planar, having sides and a back defined by a single wall 32 defining a substantially arcuate plan profile. Similarly, the central body 24 has an outer shell 47 pre-cast or otherwise formed of vermiculite concrete.

A steel anchor plate damper assembly 40 is shown in FIGS. 1 and 5. The damper assembly 40 is secured (for example with ⅜-inch×3 inch lag bolts) over a chimney aperture in the top of the smoke plenum section 26 of the firebox. The interior of the damper 41 receives the inner stainless steel chimney 43 of an air cooled steel chimney system 42, thus providing masonry-to-steel chimney connection. The damper 41 is positive open or closed. This is accomplished by a steel bar counter-weight 56. When the damper handle 57 is pushed up, the counter-weight 56 holds the damper plate 58 open. When the damper handle 57 is pushed down, the damper plate 58 closes.

Referring again to FIG. 6, it is seen that a fireplace facade frame 51 is crafted from tubular steel, for example ½-inch tubes, bent, welded and assembled to achieve the appearance of a southwestern kiva fireplace. A steel diamond mesh lath 60 is attached, as by metal screws, to the frame 51 generally to define the exterior contours of the facade 50. At least one, preferably three or more, coats of fiberglass-impregnated stucco 62 is applied to the entire facade 50, with the result that the fireplace obtains the appearance seen in FIG. 7. The frame 51 can be secured to the adjacent interior walls of the building to supply overall stability for the apparatus, a preferred and traditional location of a kiva fireplace being the corner of a room. FIG. 7 depicts the appearance of the completed apparatus, the facade 50 having been secured (e.g. by adhesives and/or screws) in place around the firebox 20 and the chimney system 42. A pleasant transition finish preferably is applied to aesthetically join the edges of the facade 50 to the adjacent walls.

The facade 50 is completely factory manufactured. The facade 50, with frame 51, is transported to the installation site, and is secured to the firebox and to the site structure (e.g. walls), and then added stucco 62 is applied.

Figure 8:
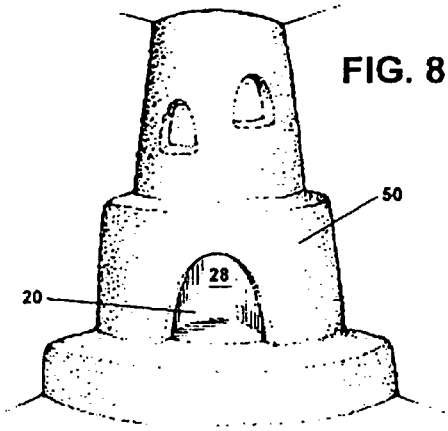
FIGS. 8–10 illustrate various different kiva styles of facade according to the present invention, surrounding a firebox component of the invention, to provide aesthetic, lightweight fireplaces for use.
Figure 9:
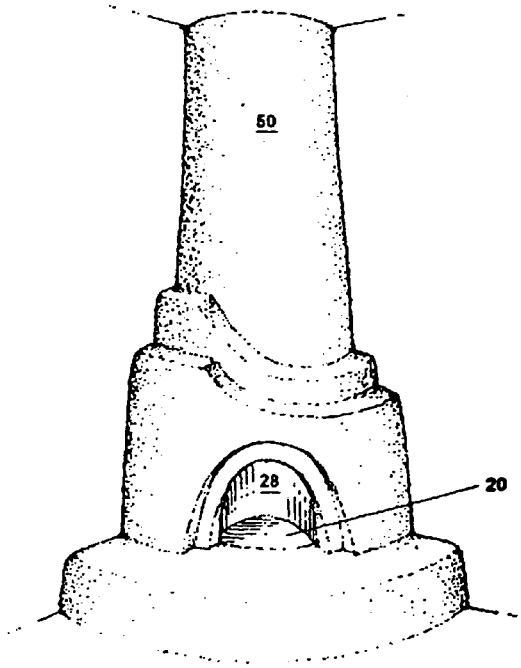
Figure 10:
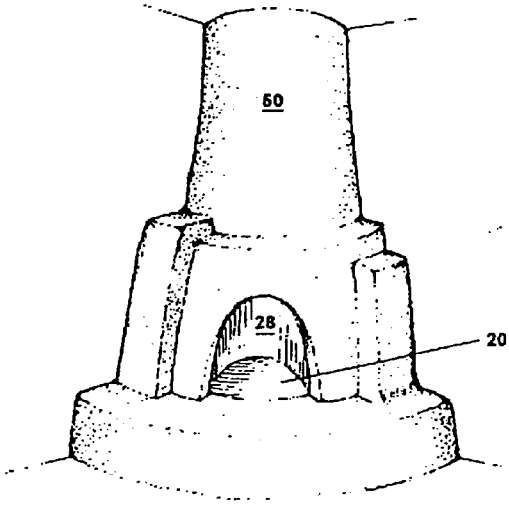

FIGS. 8, 9 and 10 illustrate additional alternative fireplace designs according to the kiva embodiment of the invention. It will be readily appreciated by one of ordinary skill in the art that the flexibility in design provided by the use of the facade frame 51 permits the inventive apparatus to have a facade 50 manifesting any of a wide variety of custom exterior appearances. All aesthetic designs may be manufactured according to the foregoing disclosure.

Figure 5A:
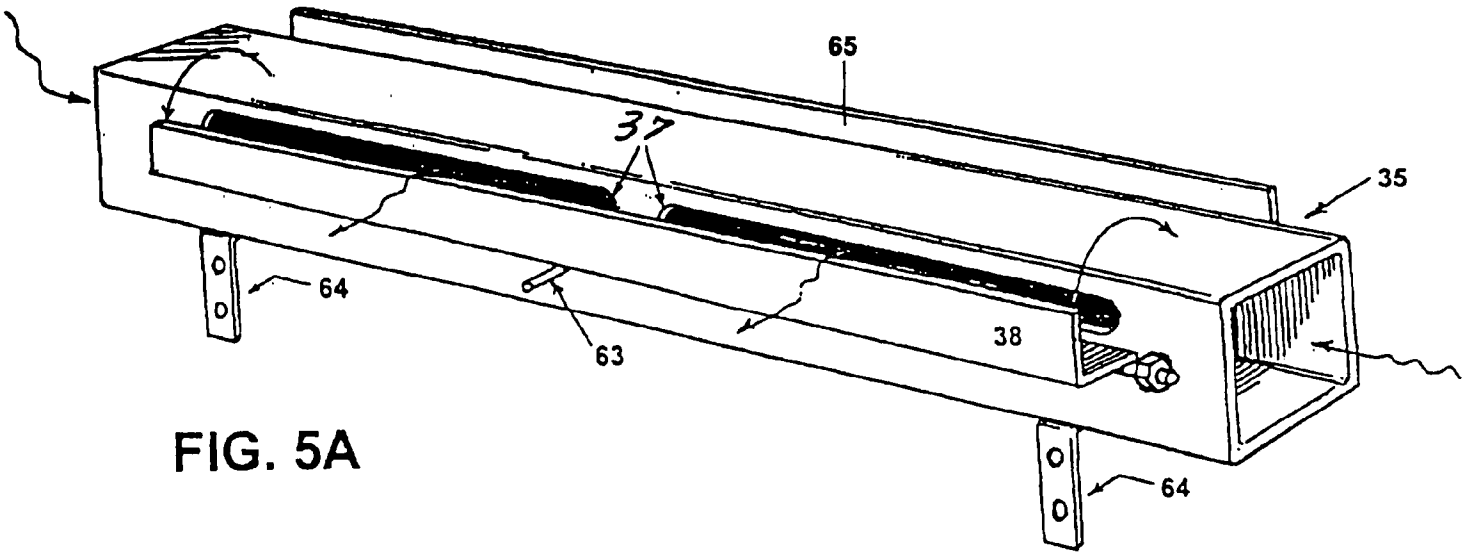
FIG. 5A is an enlarged perspective view of the combustion air flume element of the invention seen in FIG. 5.

Referring particularly to FIGS. 5 and 5A, the inventive fireplace optionally but preferably includes a combustible air flume 35, attached to the base 22 proximate to the box aperture 29 when the fireplace is completely assembled and the firebox 20 is in use. The flume 35 draws air toward the combustion chamber 28, as further described herein. The flume 35 essentially is a vented conduit, and preferably features some means for closing a vent hole in the conduit when the fireplace apparatus is not in use.

The combustion air flume 35 is mounted to the face of the base 22, halfway below the box aperture 29. This mounting can be accomplished by, for example, angle brackets 64 and #8×2½ inch screws. The flume 35 is mounted so as to position a vent 37 towards the combustion chamber 28. A hinged vent door 38 is provided upon the flume 35 as a means to controllably open and close the vents 37, the vent apertures preferably being closed when the fireplace is not in use. A handle 63 is mounted upon the vent door 38 for ease and safety of manipulating the door 38. As seen in FIG. 5A, when the vent door 38 is opened, it exposes and uncovers at least one vent aperture, e.g., a pair of vents 37 in the form of two ¾-inch by 15-inch slots in the flume 35; the flume 35 preferably is a conduit crafted from, for example, a length of 2-inch by 2-inch (or 4-inch by 4-inch) square steel tube with open ends. The door 38 can be a length of right-angle-iron mounted with hinges upon the flume 35. The hinges permit the door to pivot between an open and a closed position; to open, the handle 63 is pushed toward the fireplace (directional arrow in FIG. 5). FIG. 5A shows the flume 35 in an open position; to close, the user can simply pull on the handle 63 to pivot the door 38 forward (directional arrow in FIG. 5A) to rotate the vent door into a position covering the vents 37. A plaster stop and door channel 65 is mounted on the face of the flume 35, and provides a finished edge at the fireplace opening and a slot for screen or glass doors.

In use, the flume 35 draws air in through its open ends, and delivers the air to the combustion chamber 28 of the firebox 20. An approximately 6-inch diameter vent (not shown) is required in an outside wall of the associated building structure to provide outside air within the interior frame cavity defined by the facade frame 51. Such outside air also provides cooling for the double-walled chimney system 42.

A door frame and glass and/or screen door (not shown) may be provided in and for the facade aperture 52 generally according to convention, to prevent embers from popping from the chamber onto the building floor.

From the foregoing, it is also evident that the invention includes a method of assembling a lightweight modular fireplace. The method includes the initial step of assembling the firebox 20 by pre-casting the base 22 of vermiculite concrete, and pre-casting the central body 24 of vermiculite concrete. Then, the method includes stacking the central body 24 upon the base 22 and connecting the central body to the base, the firebox 20 partially surrounding the combustion chamber 28, and also stacking the smoke plenum section 26 upon the central body 24 and connecting the plenum section to the central body. Other steps of the method are fashioning the facade frame 51 from tubular steel, locating the facade frame 51 around the firebox 20, thereby at least partially surrounding and enclosing the firebox 20, and covering the facade frame with stucco, as described above.

The preferred embodiment of the kiva firebox of the invention may now be described, with the foregoing description of an acceptable alternative firebox embodiment serving as reference and background. All versions of the firebox component described herein are useable with the facade component 50 as described. A preferable firebox offers advantages of simpler construction and improved safety vis-à-vis the alternative firebox disclosed previously. The preferred embodiment features modular construction, but the base, central body, and smoke plenum section are differently configured. The general concept of the invention as described above remains the same, and the construction materials are unchanged. A separately devised front portion, defining the firebox aperture, is provided. Thus, the description of the alternative embodiment of the firebox above applies as well to this preferred embodiment, with the exception of the differences specifically noted and described below.

FIGS. 11A–11D show the base 122, central body 124, front 200 and smoke plenum section 126 that are assembled to comprise the firebox 120 of one preferred embodiment. FIGS. 11A–D offer a generally progressive depiction of the firebox 120 (FIG. 11D) at serial stages of assembly. The base 122 is planar, and is provided with centrally disposed refractory bricks, as seen in FIG. 11A. The base 122 is placed upon a suitable base or pedestal, such as cinder blocks or the like.

FIG. 11B shows the situation of the central body 124 upon the base 122. The central body 124 is markedly distinct in its overall shape from the central body of the previously disclosed alternative embodiment. As seen in FIG. 11B, the central body 124 is generally semi-cylindrical in shape; the cast vermiculate concrete wall defines coaxial semi- or hemi-cylindrical interior and surfaces. The precise overall shape of the central body 124, in the horizontal section, may actually be a modified or stylized paraboloid, providing for added front-to-back depth of the combustion chamber 128, but characterizing the central body as hemi-cylindrical fosters basic description of the apparatus. The wall of the central body 124 may have approximately the same thickness (e.g., 4–5 inches) as in the alternative embodiment. The interior surface of the central body 124, which defines the space of the combustion chamber 128, is covered with the split refractory bricks in generally the same manner as previously described. Notably, the interior firewall of the central body extends upward all the way to the plenum section 126, and is lined with refractory brick throughout its height. The transition surfaces 130–135 (described further below) of the interior of the smoke chamber plenum 126 are arranged so to intercept and direct hot gases and smoke rising from anywhere within the combustion chamber 128 interior to the central body 124.

Referring to FIG. 11B, it is seen that the arcuate exterior dimension of the exterior of the central body 124 corresponds generally with the dimension of the arcuate exterior of the base 122 so that the exteriors of the base 122 and body 124 are in flush registration (i.e., define the same imaginary curve) when the central body is paced on the base. Further, it is seen that the forward ends 81, 81' of the central body 124 are aligned to be in coplanar registration with the forward end 83 of the base 122.

This embodiment has a separate front 200 section for the firebox. The front 200 has a generally planar vertical exterior surface and a generally planar interior vertical surface, these surfaces being about parallel and thus defining a front wall of approximately 4–5 inches thickness. The front 200 defines therein the arched firebox aperture 129. The front has a flat top, and is equal in height to the height of the central body 124. Accordingly, when the front 200 is secured in place, its flat top is coplanar with the flat top of the arcuate wall of the central body 124, as seen in FIG. 11C. Also as best seen in FIG. 11C, during assembly the interior vertical surface of the front 200 is placed and secured flush against the forward ends 81, 81' of the central body 124. Therefore, the front 200 when secured to the central body 124 actually "overhangs" or protrudes forward from the forward end 83 of the base 122 a distance corresponding approximately to the thickness of the front 200. The space defined below the front 200 and in front of the forward end 83 of the base 122 is sized to receive an air flume (e.g. 35 in FIGS. 5A, 15), which is attached to the base 122. When a preferred embodiment is fully assembled, therefore, the flume 35 fits snugly between the supporting pedestal and the bottom surface of the front 200 Similarly, the front-to-back dimension of the flume 35 preferably is about equal to the wall thickness of the front 200, so that in the assembled firebox 120, the front surface of the flume 35 is in coplanar registration with the front or exterior vertical surface of the front 200.

In this embodiment, the smoke plenum section comprises a single pre-cast component defining a substantially planar top and a central chimney aperture. The transition surfaces, for directing combustion smoke and vapors to converge upward toward the chimney, are defined on the bottom of a single pre-cast component, arrayed around a central chimney aperture.

The smoke plenum section 126 is placed upon and secured to the top surfaces of the central body 124 and front 200, as seen in FIG. 11D. The smoke plenum section 126 has a flat bottom surface for flush contact and juncture with the flat tops of the front 200 and central body 124. It also features a generally planar, flat top, as seen in FIG. 11D. Also, as is evident from FIG. 11D, the arcuate dimension of the curved back wall of the plenum section 126 is contoured to correspond to the radius or definition of curvature of the exterior surface of the central body 124, so that the exteriors of the plenum section 126 and central body define generally the same curvature to be in aesthetic alignment. The forward surface 85 of the plenum section 126 is coplanar with the forward or exterior surface of the front 200 when the components are assembled, as seen in FIG. 11D.

Figure 12A:
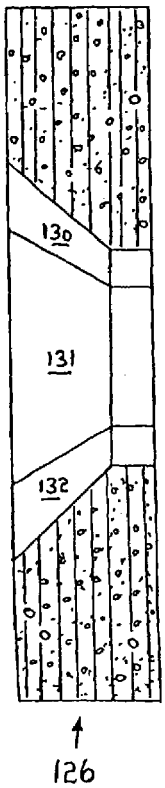
FIGS. 12A–12C are various views of the smoke chamber plenum component of a preferred embodiment of the invention.
Figure 12B:
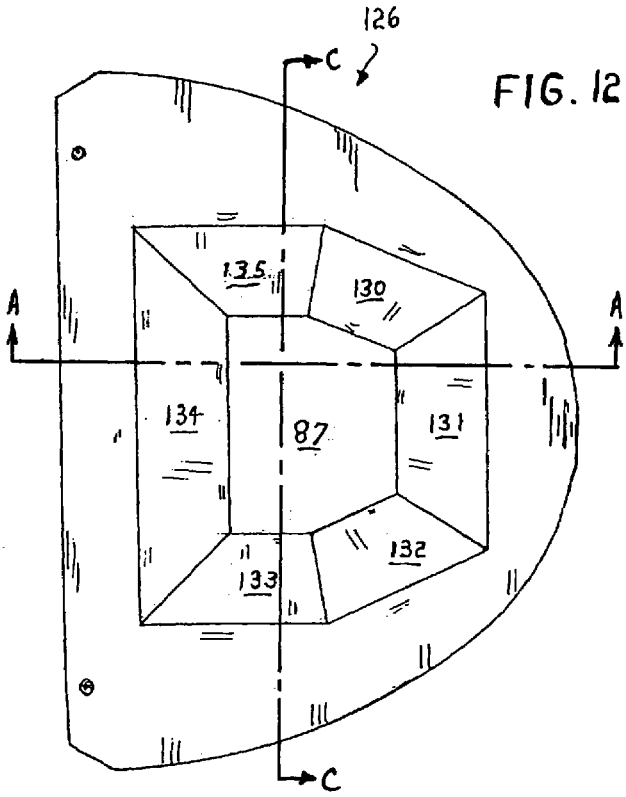
Figure 12C:
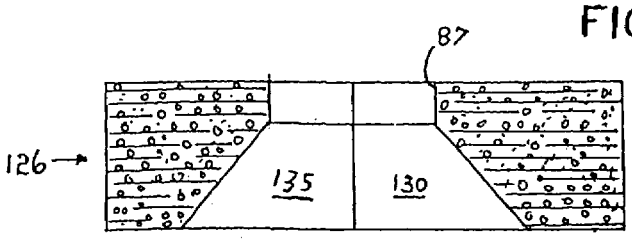

Added detail of the smoke plenum section 126 is provided in FIGS. 12A–12C. FIG. 12B is a bottom view of the plenum section 126, that is, its appearance as if viewed by an observer looking upward from within the combustion space 128. FIG. 12A is a sectional view taken in a lateral plane (i.e., a vertical section from side-to-side, section A—A in FIG. 12B) of the plenum section 126, while FIG. 12C is a sectional view in a vertical place disposed front-to-back (section C—C in FIG. 12B). FIGS. 12A–12C illustrate that the body of the plenum section 126 has a central chimney aperture 87 defined there through, via which smoke exits the combustion chamber 128 for exhaustion via an air-cooled steel chimney system, generally as previously described herein. Significantly, the smoke chamber plenum 126 does not define any part of the arched firebox aperture 129.

The plenum section 126 preferably is cast from lightweight vermiculite concrete, and is cast with interior transition surfaces 130–135. The transition surfaces 130, 131, 132, 133, 134, 135 are inclined from vertical and canted in an upwardly convergent array, as illustrated especially in FIGS. 12A and 12C, to direct rising smoke and vapors from the entire volume of the combustion chamber 128 to the relatively narrower chimney aperture 87. The chimney aperture 87 is fit with and covered in part with an anchor plate damper assembly (40 in FIGS. 1 and 5). Thus, the interior of the plenum section 126 effectively defines a smoke funnel for gathering combustion by-products for directional flow to the chimney system.

Figure 13:
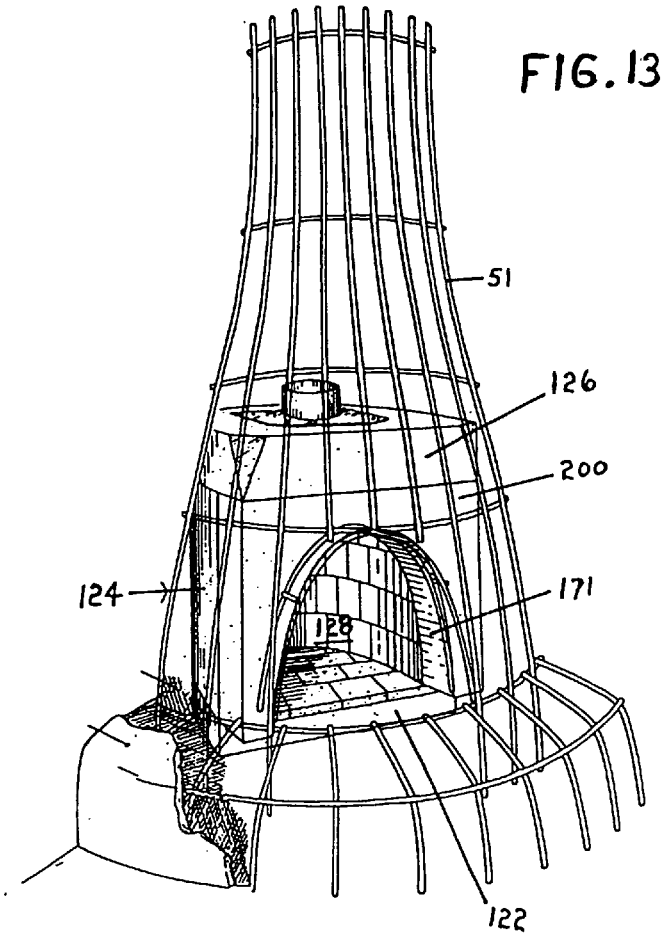
FIG. 13 is a front perspective, partial sectional view showing a preferred embodiment of the firebox according to the present invention, situated within the tubular frame, with partial sections of the lath mesh and stucco applied to the hearth portion of the frame.
Figure 14:
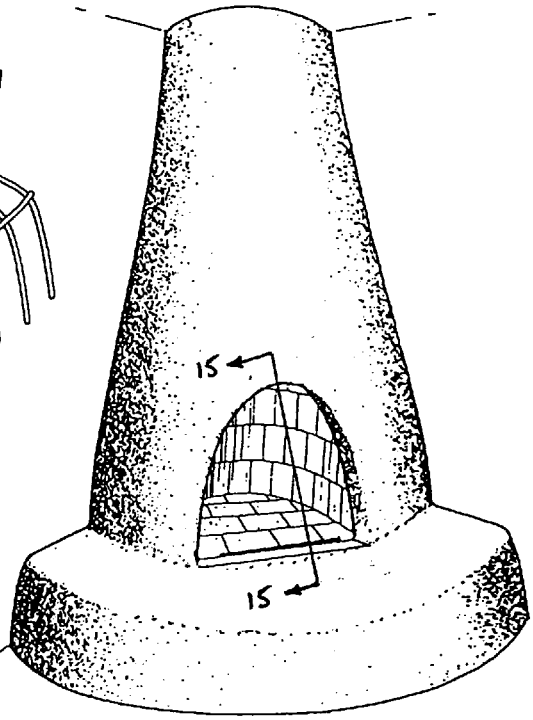
FIG. 14 is a front perspective view of the fully assembled apparatus according to the embodiment of FIGS. 11–13.
Figure 15:
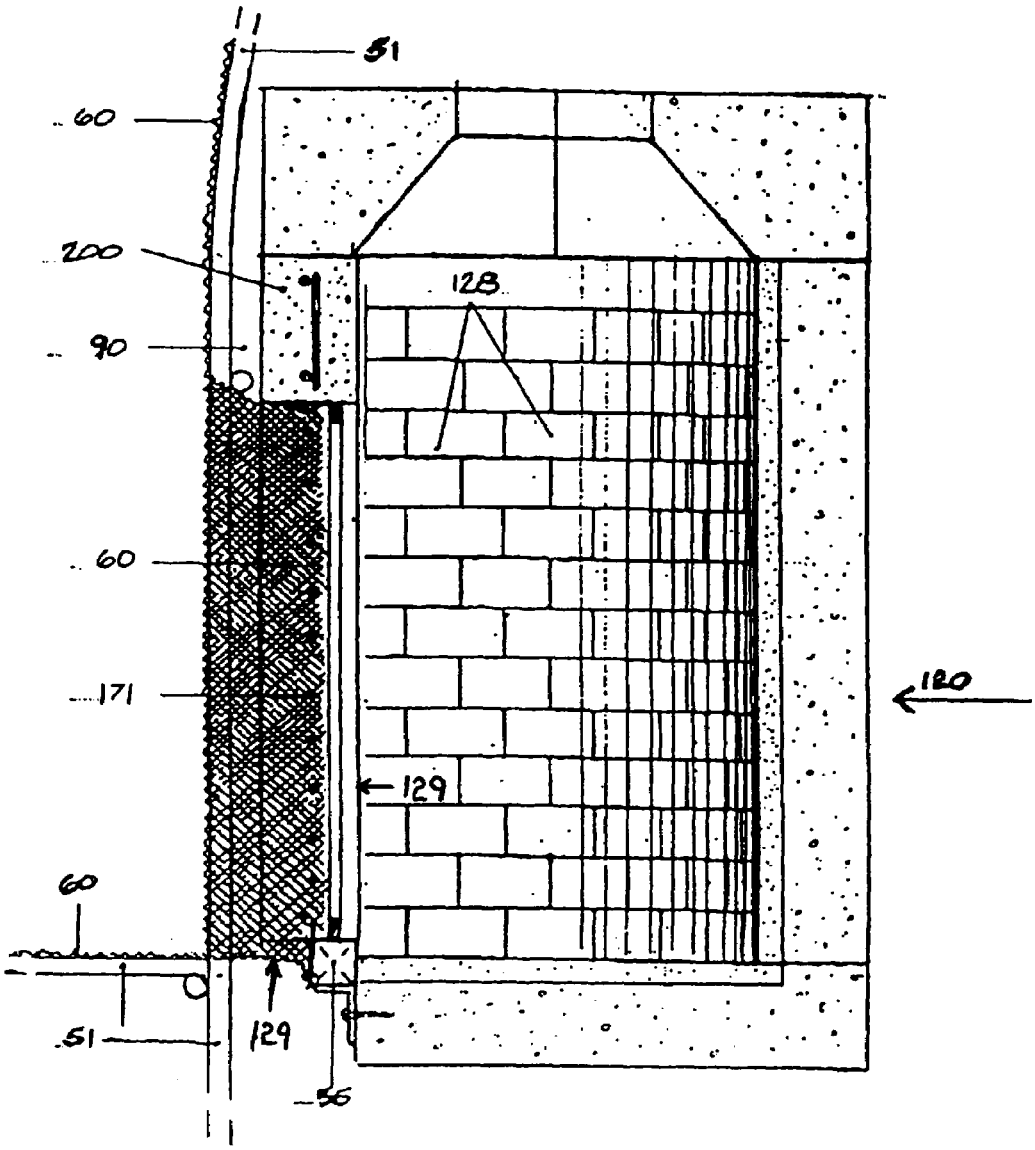
FIG. 15 is an enlarged, partial side sectional view of the firebox aperture portion of a preferred embodiment of the apparatus, as taken generally along section line 15—15 in FIG. 14.

Attention is invited to FIGS. 13 and 15. It is seen that the box aperture 129 in the front 200, as lined by the box aperture wall 171, can be closely tailored in size and shape to closely register with the size and shape of the corresponding aperture in the steel tube frame 51. The correspondence in the respective combustion chamber openings (firebox and frame) in this preferred embodiment is improved in comparison to the previously described alternative embodiment, and permits the wire mesh lath overlay 60 to be wrapped around the corner tube defining the edge of the frame's firebox opening and folded directly into contact with the arched box aperture wall 171 of the front 200. By closely matching the firebox openings in frame 51 and front 200, the possibility of dangerous flames or hot gasses improperly venting between the front of the firebox 120 and the frame 51, and entering the void defined inside the frame, is prevented. When the entire frame 51 is covered with mesh lathe and then stuccoed and plastered, as previously described, the completed apparatus has the pleasant aesthetic appearance seen in FIG. 14.

Reference to FIG. 15 provides added description of the improved safety feature of the invention. FIG. 15 is an enlarged, partial, side section view of the aperture portions of the apparatus, taken generally along section line 15—15 on FIG. 14. The firebox 120 is situated in the interior space confined in the facade defined by the tubular frame 51. There is a small gap or space 90 between the tubular frame 51 and the components constituting the firebox 120, particularly between the frame and the exterior of the front 200. The screen lath 60 is securely attached to the outside of the frame 51 to define the contours of the exterior facade, as previously described. This preferred embodiment of the invention prevents flames and hot gases from exiting the combustion chamber 128 and entering the space 90 between the exterior of the firebox 120 and the interior of the lath-covered frame 51. This prevention is provided by the expedient of cutting the screen lathe 60 in a manner to permit it to be folded into the firebox aperture 129 and secured directly to the box aperture wall 171, as with screws or the like. The folded lath 60 thus defines an arched "tunnel" between the frame's aperture and the firebox aperture 129. The lathe 60 is coated with refractory cement (not shown in FIG. 15) through the interior extent of the arch, to isolate the interior of the aperture tunnel from the space 90 between the outside of the firebox 120.

This preferred embodiment offers two significant advantages over the previously described alternative embodiment. The most important advance is in safety. This preferred embodiment also is simpler and less expensive to assemble.

In the afore-described alternative embodiment, it was determined that there is a possibility for inadequate functional closure between the lath-covered frame and the exterior of the firebox in the vicinity of the firebox aperture 29. Due to the fact that in the former, alternative embodiment, the firebox aperture 29 was not as closely aligned with, and was separated a substantial horizontal distance from, the corresponding aperture in the frame 51, it is thus easier to mistakenly make a faulty installation with that embodiment. Sealing the gap or space (analogous to the narrow gap 90 in FIG. 15) is more problematic. Modestly sized pieces of screen mesh 60 sometimes have to be specially cut and sized for fitting between the frame and firebox, and interiorly covered with high-temp refractory mortar. This task must be performed with care, to avoid the leaving of an open gap whereby flames or hot gas can rise upward out of the combustion chamber 28 and into the void between the firebox and frame 51. Installers sometimes inadvertently close the gap with ordinary plaster or stucco which is unable to withstand exposure to the temperature extremes of the vicinity. In extreme, and hazardous, cases, the plaster or stucco bakes, cracks, and falls away, leaving an open passage for the escape of hot gas or even flames from within the firebox to the space inside the frame and facade. In this embodiment, the frame 51 is part of the interior of the firebox.

In this preferred embodiment, and as shown in FIG. 15, the gap between frame 51 and the outside of the firebox 120 is much more readily and easily closed and sealed, by the mesh 60 being attached directly to the box aperture wall 171. The configuration and location of the front 200 results in the box aperture 129 being situated much closer to, and better aligned with, the aperture in the frame 51, so that the gap 90 is rapidly closed with mesh lath 60 covered with an refractory cement lining.

This preferred embodiment also is much simpler and cost effective to manufacture. In the alternative embodiment, both the plenum section 26 and the central body 24 have a number of geometrically complicated surfaces. The plenum section 26, in particular, has a number of compound angles and complex surface relationships in its inner plenum wall 31, complicating its construction and lining. (The smoke chamber plenum 26 of the alternative embodiment may have to be cast in several pieces and then assembled.) Further as seen in FIG. 1, for example, the plenum 26 also defines the upper portion of the arched combustion chamber aperture 29. The firebox aperture 29 thus is defined by both the central body 24 and the smoke chamber plenum 26, requiring careful assembly to proved a safe and aesthetic registration between the two components.

In marked contrast, in the embodiment of FIGS. 11–15, the smoke chamber plenum 126 can be cast as a single piece. After the master mold is originated, the interrelationships and locational dispositions of the transition surfaces 130–135 are fixed, and easily and repeatedly reproduced by expediently pouring multiples of the vermiculite concrete in the plenum mold.

Figure 15A:
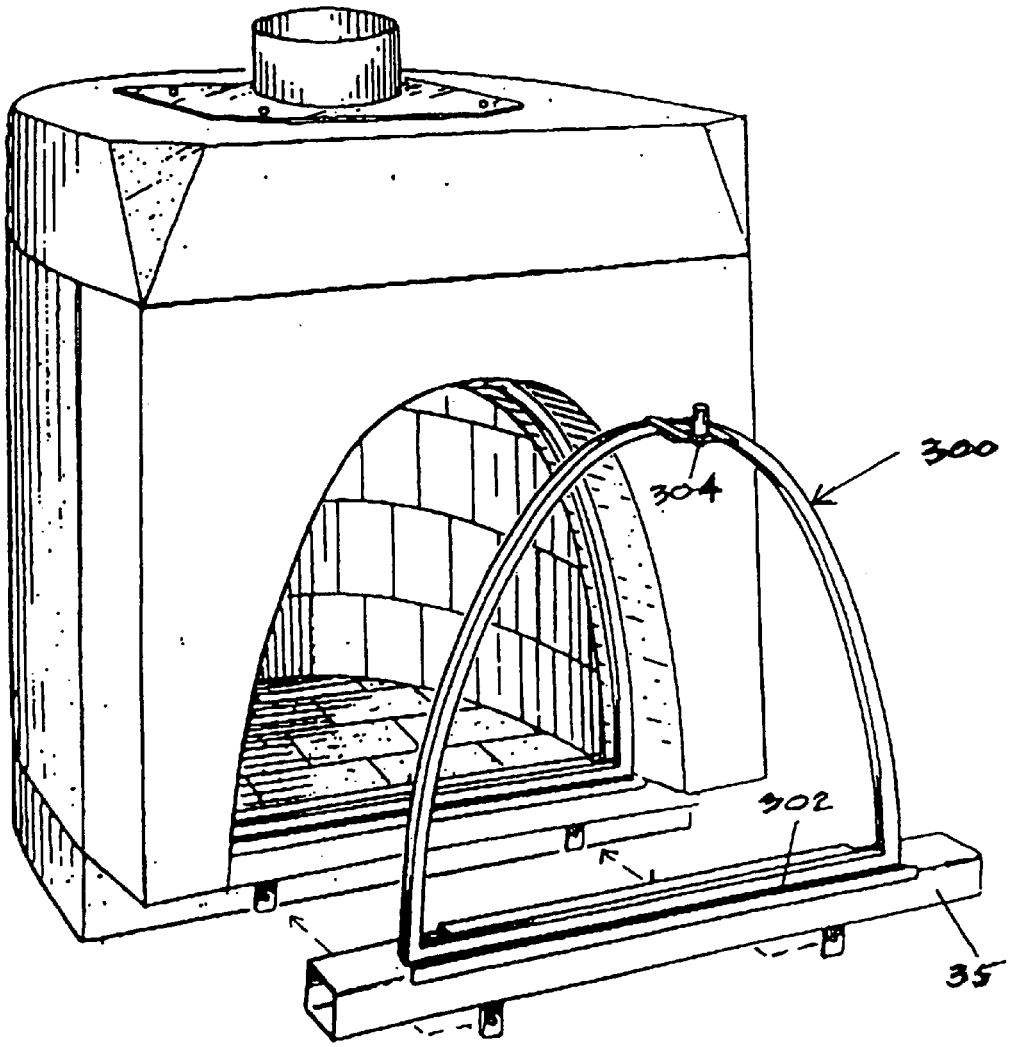
FIG. 15A illustrates a door frame for receiving a removable door, useable in all kiva-style embodiments of the apparatus of the invention.

Also, the provision of a separate front 200 as described simplifies the definition of the firebox aperture 129. The arched aperture is cast in the one-piece front section 200, so that the aperture is uniform, the arched front 200 is structurally sound, and the firebox aperture is defined by one component instead of two. Assembly of the complete firebox is more simply and elegantly accomplished, resulting in a faster installation and a confined firebox FIG. 15A shows that a doorframe 300 can be provided for fitting into the firebox aperture 29, 129 of the kiva-style embodiment of the invention. The steel frame can removably mount a framed glass door (not shown) whose bottom can be inserted into the door support track 302 defined in the bottom of the frame 300. The top of the door can be clipped into place by the detent mechanism 304 at the apex of the frame 300. Thus, the user of the apparatus can easily insert, remove, and re-attach the glass-framed door to repeatedly access and close the combustion chamber of the firebox. It is noted that the doorframe 300 can be secured directly to the flume 35. The flume 35 is described herein above.

Figure 15B:
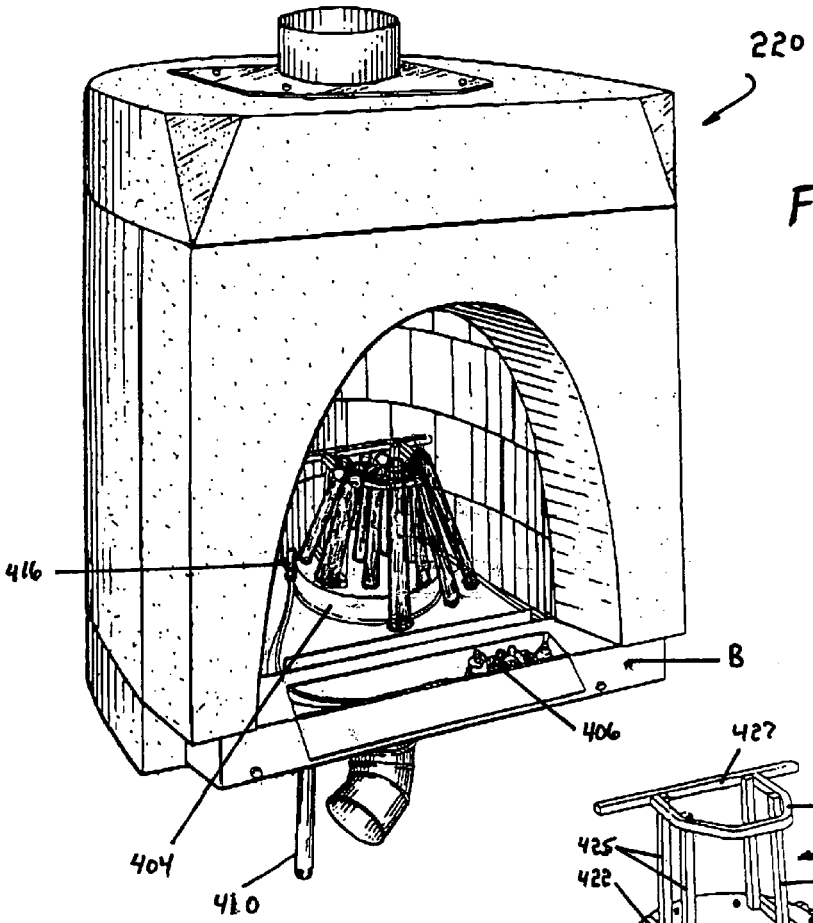
FIGS. 15B and 15C are front views of a gas burner appliance as optionally insertable into a fireplace apparatus according to the present invention.
Figure 15C:
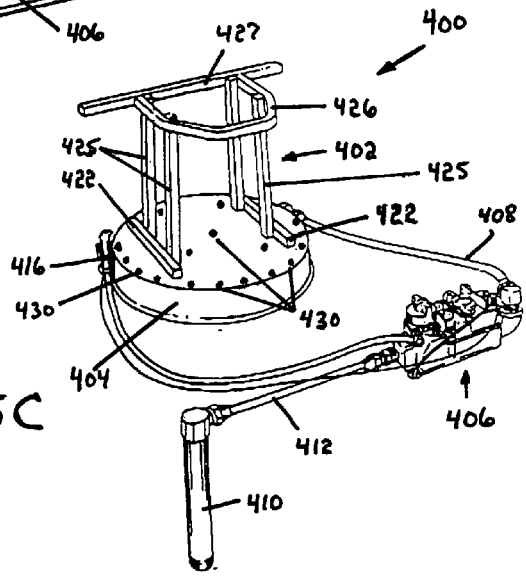

The invention can be adapted for use as a gas-burning fireplace. Most conventional gas-burning fireplaces use a simple perforated tube as the burner element, with an array of decorative, non-combustible, simulated "logs" stacked above and in front of the burner. As a result, the flames at the burner are obscured in a manner which betrays the artificiality of the logs. Reference is invited to FIGS. 15B and 15C, which show an improved accessory for use with the embodiments of the invention. This gas burning insert appliance 400 permits the fireplace to burn natural gas or propane or the like, while improving the overall natural look and aesthetics of the flames. The appliance 400 features a metal frame or rack 402, a burner pan 404, valving and starter assembly 406, and gas feed line 408. Natural gas or propane or the like is supplied to the appliance from the conventional stub 410 via the intake line 412 generally according to convention and applicable codes. The starter and valve assembly 406 includes a valve for regulating the flow of gas to the burner pan 404, and also permits the ignition of gas combustion at the pan 404 by means of the pilot light device 416. The construction and operation of the valving and starter assembly 406 and pilot light device 416 are generally known in the art. Gas is conveyed from the valve and starter assembly 406 to the pan burner 404 via the feed line 408. Within the pan 404, gas is conveyed and directed from the feed line 408 to the various ones of the burner holes 430 in the top surface of the burner pan 404. Gas is emitted from the holes 430 for combustion. As seen in FIG. 15B, the valve and starter assembly 406 may be discreetly located within a compartment at the front of the base B of the fireplace 220, where they can be covered by a trap door so to be unseen when not being used.

The burner pan 404 and log rack 402 function in combination to provide for a more natural-appearing fire than heretofore known. Both the pan and the rack preferably are made of durable steel or iron or other metals or alloys. As best seen in FIG. 15C, the rack 402 has a pair of horizontal base members 422 for stable placement upon the top surface of the pan 404. Extending upward from each base member, and leaning slightly inward toward the center of the rack 402, are two or more thin rigid posts 425. The four or more posts 425 in the rack support, and are interconnected at their tops by, a horizontal generally semicircular or U-shaped log support beam 426. The open side of the log support beam 426 is closed by an elongated horizontal back girder 427. The base members 422, posts 425, girder 427 and log support beam 426 are all inter-joined, as by welding or the like, to form or define an integral unitary rack unit 402.

The generally hollow burner pan 404 preferably is circular and disc-like in overall shape, as seen in FIG. 15C. The burner pan has a plurality of burner holes 430 in the upper horizontal surface thereof. The burner holes 430 are arranged in any of a variety of possible random arrays or assorted patterns in the burner pan 404, some burner holes being nearer the radial center of the pan, as seen in the figure, and there preferably being a plurality spaced along the peripheral edge of the pan, as also shown.

When the appliance 400 is in use, and as suggested in FIG. 15B, noncombustible simulated logs are leaned upward against the rack 402, especially against the log support beam 426. The bottom ends of the simulated logs rest on the top of the burner pan 404 or on the base B in the combustion chamber. Simulated logs can be placed upright both within and without the D-shaped loop defined by the log support beam 426 and the girder 427. Importantly, the bottoms of the several simulated logs can rest at differing radial positions with respect to the center of the burner pan 404, so that the bottom ends of some logs are "inside" of some burner holes 430 while the bottom ends of others are "outside" those and other burner holes. As a result, the flames from the burning gas emitted from the plurality of holes 430 are intermingled with and flicker between and among the uprightly arranged simulated logs, resulting a more random effect and overall more naturally appearing burning appearance in the fireplace (especially when compared with most convention gas burner devices.

Attention is invited to FIGS. 16–26 which depict another preferable embodiment of the invention. This contemporary Rumford-style embodiment is similar in many respects to the kiva-style embodiment of FIGS. 11–13, but offers the advantage of having a firebox with no arcuate or curved castings; also no exterior tube-framed facade is required. The Rumford-style embodiment of the inventive fireplace is assembled from modular components that have only rectilinear edges and planar surfaces; the central body, in particular, comprises a plurality of interconnected substantially planar components, as does the smoke plenum section. The molds for this firebox 220 are thus simpler to make and use, and many users may find assembly easier as well. The firebox of FIGS. 16–26 is useable in combination with the facade 50 component as previously described, including the advantages discussed in conjunction with FIG. 15.

The description of this second preferred firebox embodiment 220 is informed by the descriptions of the embodiments previously disclosed herein. The description here following accordingly is comparatively succinct, but is readily understood by reference to the drawings. This second preferred embodiment of the firebox component includes eleven modular components. The inside of the firebox 220 is has a one-inch lining of rust-colored refractory cement, cast in a herringbone pattern, and backed up with lightweight vermiculite concrete, as are the component pieces. Again, the configuration and method of assembly of this second alternative embodiment of the firebox is generally the same as, and apparent from, in the alternative descried above previously, but as specifically detailed below.

Figure 18:
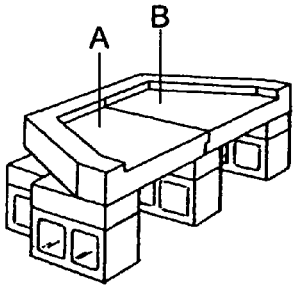
FIG. 18 is a front left side perspective view of the two base components of the apparatus according to the embodiment of the invention shown in FIGS. 16 and 17.
Figure 19:
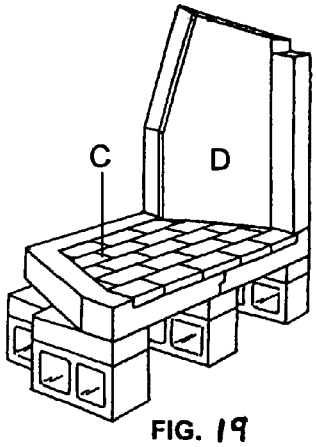
FIG. 19 is a front left side perspective view of the embodiment of the invention, showing the first right side component installed on the base of the fireplace, with base bricks installed.

FIG. 18 illustrates the base of the fireplace comprised of two (right and left) base sections A and B, disposed upon an array of cementitious blocks for elevating and thermally insulating the fireplace. The base sections A, B are keyed to fit together along the centerline of the fireplace 220. Refractory mortar is applied along the centerline key joint and the base sections set in place, as indicated in FIG. 18, to define a base with a roughly trapezoidal footprint. The assembled base preferably features an elevated rim on three sides, as shown in FIG. 18, to define a recessed area for containing a layer of refractory bricks for lining the combustion chamber floor. A thin coat of refractory mortar is then applied over the recessed base area, and split firebrick C is set in place, as shown by FIG. 19.

Figure 20:
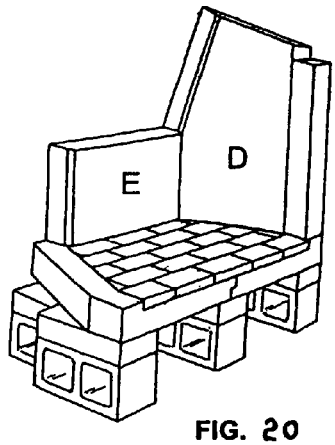
FIG. 20 is a front left side perspective view of the embodiment of the apparatus seen in FIG. 16, showing the first back component installed on the base of the fireplace.

A thin layer of refractory mortar is then applied on top of the concrete rim portion of the base. Referring to FIG. 19, a first right side component D is aligned with and situated on the corresponding outside edge of the base A, B. Referring to FIG. 20, refractory mortar also is applied to the vertical sides of the first back component E, which then is aligned with the back edge of the base and with the rear corner of the first right side component D and set in place.

Figure 21:
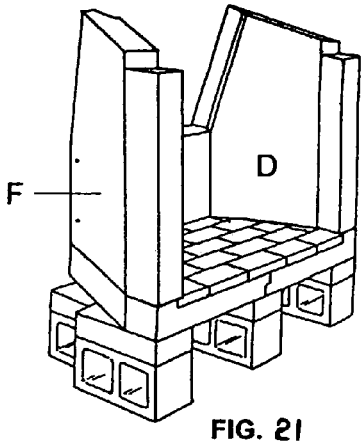
FIG. 21 is a front left side perspective view of this embodiment of the apparatus, showing the first left side component installed on the base of the fireplace.
Figure 22:
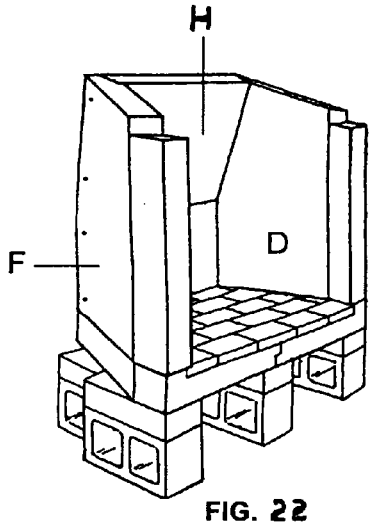
FIG. 22 is a front left side perspective view of the embodiment of the apparatus seen in FIG. 20, showing the second back component installed upon the first back component.

Turning to FIG. 21, it is seen that refractory mortar is then applied to the joining edges of the first left side component F, which is then aligned with the corresponding side edge of the base, and lag bolted to the first back component E. The first right side component D likewise is lag bolted to the first back component E. The first side components D, F generally define irregular pentagons in overall shape, while the first back component is shaped generally as a rectangle. As best seen in FIGS. 19 and 22, the first side portions D, F have small horizontal ledges defined at their front top corners, but the principal lengths of the upper edges of the sides D, F are inclined somewhat, rising from front to back as seen in FIGS. 20–22.

The trapezoidal second back component H is ready to be set in place. Refractory mortar is applied on exposed joining edges of both first side components D, F, as well as along the exposed top edge of the first back component E. FIG. 22 shows that the second back component H is lowered (shorter bottom edge down) onto the correspondingly-sized and shaped space between the first side components D, F, and set in place upon the first back component E. This second, or upper, back component is secured to the side components D, F with lag bolts.

Figure 23:
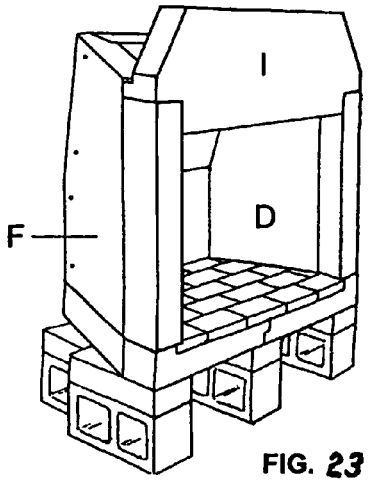
FIG. 23 is a front left side perspective view of this embodiment of the apparatus showing the first front component installed on the two side components of the fireplace apparatus.
Figure 24:
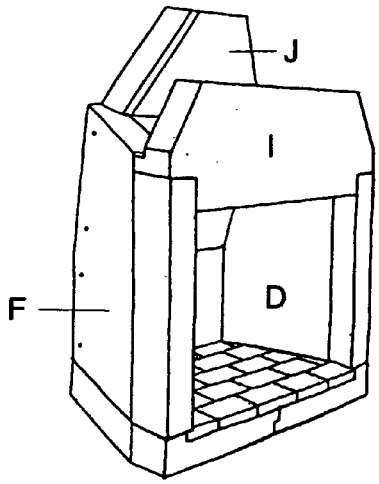
FIG. 24 is a front left side perspective view of the embodiment of the apparatus seen in FIG. 22, showing the third back component installed on the second back component of the fireplace apparatus.
Figure 25:
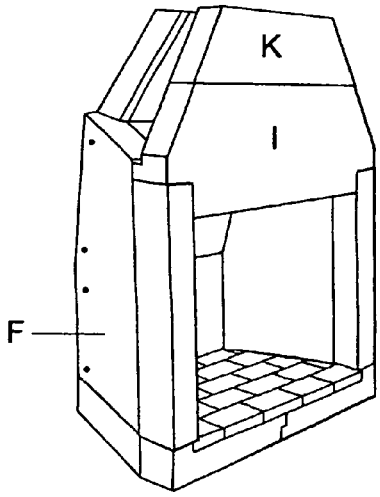
FIG. 25 is a front left side perspective view of this embodiment of the apparatus showing the second front component installed upon the first front component of the fireplace apparatus.

Reference is made to FIG. 23. Refractory mortar then is applied to upper surface of the dropped-down ledge at the top front corner of each of the side components D, F. The first front component I is set into place upon the front ledges of the side components, in alignment with the front of the fireplace previously defined by the base and the first side components. Refractory mortar then is applied along the top of the second back component H, and a third back component J is set in place thereon, as seen in FIG. 24. Referring to FIG. 25, refractory mortar is applied to the top of the first front component I, and a second front component K of generally trapezoidal shape is aligned with the side components D, F and disposed upon the first front component I, in coplanar alignment with it.

Figure 26:
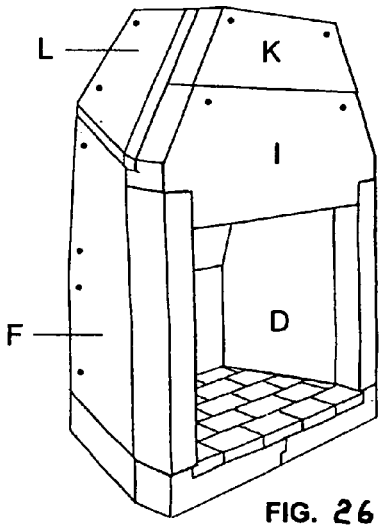
FIG. 26 is a front left side perspective view of the embodiment of the apparatus seen in FIG. 24, showing the second left component installed on the first left side component of the fireplace apparatus. (The second right side component is installed in the same manner.).

Finally, as seen in FIG. 26, the final two side components L are installed. Refractory mortar is applied to the exposed top edges of the first side components D, F and to the exposed edges of the components I, J, and K at their juncture with the second side components L. The second side components L (only one seen in FIG. 26) are then set in place.

As indicated by combined reference to FIGS. 24–26, the second, or upper, side components L rest primarily upon the top surfaces of the respective left and right first side components D, F, but also rest upon the inclined side surfaces of the third, uppermost, back portion J, as well as upon rearward-extending top surfaces or ledges of on the back of the first front component I. The second side sections L are lag-bolted to the upper second back component H.

Figure 17:
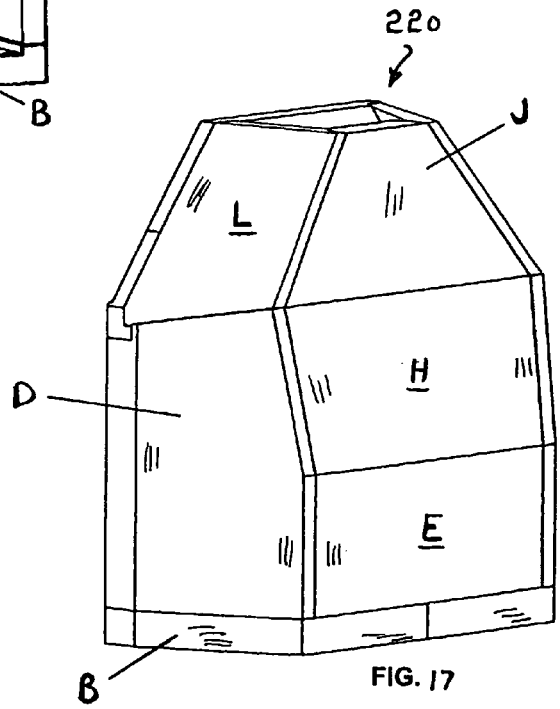
FIG. 17 is a back right side perspective view of the contemporary Rumford-style embodiment of the invention seen in FIG. 16, completely assembled.

As seen in FIGS. 24–26, and as perhaps best illustrated in FIG. 17, the third back component J and the two final side components L are inclined inwardly at suitable angles from vertical, and may have oblique bottom surfaces to accommodate their inclinations; (the third back component J is disposed upon and secured to the second back component H, while the final side components L are disposed upon and connected to respective ones of the first side components D, F). These components lean inwardly toward the center of the combustion chamber, so to create a funnel-like section of decreasing size (proceeding upward), thereby defining a plenum section which collects and directs smoke to the narrower chimney.

It is seen therefore that the first and second front components I, J, the two second side components L, and the second and third back components H, J define the smoke chamber plenum for guiding smoke from the combustion chamber to the flue and chimney. The combustion chamber is largely enclosed by the first side components D, F, the first back component E, and the first front component I, as well as the base A, B.

Figure 16:
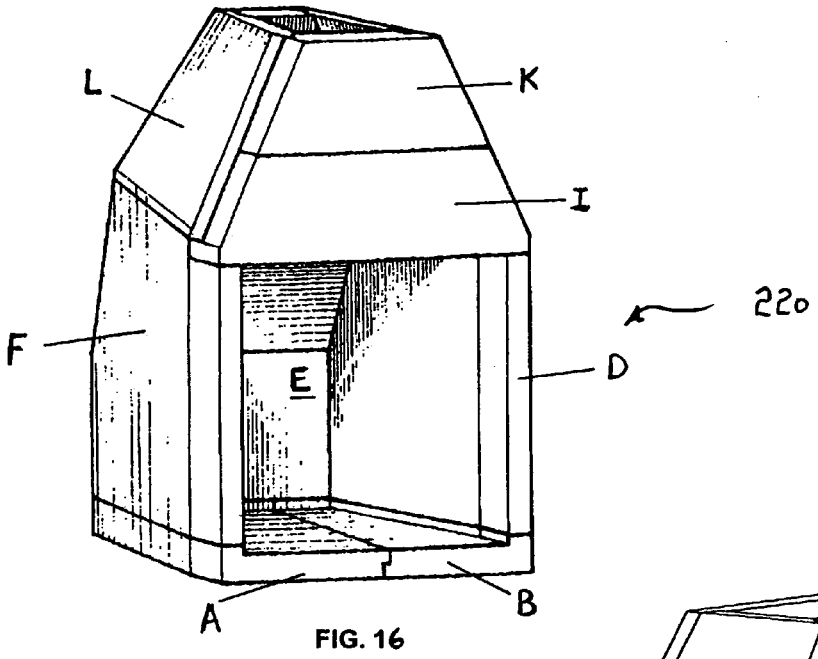
FIG. 16 is a front left side perspective view of a desirable contemporary Rumford-style embodiment of the apparatus of the invention, totally assembled.

When thus assembled, this version of the firebox 220 appears as seen in FIGS. 16 and 17. It is seen that this firebox of the apparatus and method uses solely planar components, and avoids the use of components pre-molded in more complicated arcuate shapes, as seen in FIGS. 11A and 11B.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all patents and publications, cited above are hereby incorporated by reference.

What is claimed is:

1. A modular fireplace apparatus comprising:

a firebox comprising:

a base;

a central body comprising pre-cast vermiculite concrete disposable upon said base, and comprising an inner body wall defining and partially surrounding a combustion chamber;

a smoke plenum section comprising pre-cast vermiculite concrete, disposable upon said central body, and comprising transition surfaces for directing smoke to a chimney;

a front portion comprising pre-cast vermiculit concrete and defining a box aperture opening into said combustion chamber; and a facade locatable around said firebox to at least partially surround and enclose said firebox, said facade comprising:

a lightweight frame comprising a plurality of rigid metal tubes, said frame defining a facade aperture; and a metal mesh fixedly secured to said lightweight frame and said front portion around said box aperture opening, whereby said mesh extends between said frame and said firebox; and at least one coat of stucco applied to said wire mesh;

wherein said base, central body, and plenum section are modular, said facade aperture is alignable with said box aperture to permit access through said facade into said combustion chamber, and said central body connectable to said base and said smoke chamber connectable to said central body by refractory mortar.

2. The modular fireplace of claim 1 further comprising a flume attachable to said base for drawing air toward said combustion chamber.

3. The modular fireplace of claim 2 wherein said flame comprises a substantially rectangular shape.

4. The modular fireplace of claim 3 wherein a front of said flume is disposed in substantially coplanar registration with a front surface of said front portion.

5. The modular fireplace of claim 1 wherein said central body comprises a single arcuate component.

6. The modular fireplace of claim 1 wherein said central body comprises a plurality of interconnected substantially planar components.

7. The modular fireplace of claim 6 wherein said central body comprises:

a first right side component and a first left side component, said side components disposed upon said base;

a substantially rectangular, lower, first back component disposed upon said base; and a trapezoidal second, upper, back component disposed upon said first back component.

8. The modular fireplace of claim 7, wherein said smoke plenum section comprises:

a third back component inclined at an angle from vertical and disposed upon said second back component; and at least two final side components inclined at an angle from vertical and disposed upon respective ones of said first side components.

9. The modular fireplace of claim 1 wherein said smoke plenum section comprises a single pre-cast component comprising:

a substantially planar top; and a central chimney aperture;

wherein said transition surfaces are defined on the bottom of said single pre-cast component, arrayed around said chimney aperture.

10. The modular fireplace of claim 1 wherein said front portion comprises a single component defining an arched box aperture.

11. The modular fireplace of claim 7 wherein said first side components define horizontal ledges at their front top corners, and said front portion comprises at least one substantially planar front component disposed vertically upon said ledges.

12. A modular fireplace apparatus comprising:

a base;

a central body section comprising pre-cast vermiculite concrete, disposable upon said base, and comprising:

an inner wall defining and partially surrounding a combustion chamber, and a front portion comprising pre-cast vermiculite concrete and defining a box aperture opening into said combustion chamber;

a smoke plenum section comprising pre-cast vermiculite concrete and disposable upon said central body, and further comprising transition surfaces for directing smoke to a chimney; and a facade disposable around said base, said central body section and said front portion, said facade comprising a lightweight tubular frame and a mesh; wherein said mesh is fixedly secured to said frame and also to said front portion around said box aperture opening, whereby said mesh extends between said frame ant said front portion.

13. The modular fireplace of claim 12 wherein said base, central body, smoke plenum, and front portion are modular.

14. The modular fireplace of claim 12 wherein said facade defines therein a facade aperture, said facade aperture alignable with said box aperture to permit access to said combustion chamber through said facade.

15. The modular fireplace of claim 12 wherein said facade comprises a lightweight metal frame, and said mesh comprises a metal.

16. A method for constructing a modular fireplace comprising the steps of:

constructing a firebox comprising the steps of:

providing a base;

disposing a vermiculite concrete central body on the base, the body comprising an inner body wall defining and partially surrounding a combustion chamber;

providing a pre-cast smoke plenum section upon the central body, and comprising transition surfaces for directing smoke to a chimney; and providing a front portion, comprising pre-cast vermiculite concrete, defining a box aperture opening into the combustion chamber;

locating a facade around the firebox, comprising the step of locating a lightweight frame; and extending a metal mesh between the lightweight frame and the fire box, and fixedly securing the metal mesh to the lightweight frame and the front portion around the box aperture opening.

17. The method of claim 16 further comprising the step of providing directing air to the combustion chamber with a rectangular flume.

* * * * *